US006613491B2

(12) United States Patent
Inoue et al.

(10) Patent No.: US 6,613,491 B2
(45) **Date of Patent: *Sep. 2, 2003**

(54) ELECTROPHOTOGRAPHIC TONER, ELECTROPHOTOGRAPHIC DEVELOPER AND PROCESS FOR FORMING IMAGE

(75) Inventors: Satoshi Inoue, Minamiashigara (JP); Masahiro Takagi, Minamiashigara (JP); Kaori Ohishi, Minamiashigara (JP); Rieko Kataoka, Minamiashigara (JP); Fusako Kiyono, Minamiashigara (JP); Atsuhiko Eguchi, Minamiashigara (JP); Chiaki Suzuki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/003,088

(22) Filed: Dec. 6, 2001

(65) Prior Publication Data

US 2002/0142242 A1 Oct. 3, 2002

(30) Foreign Application Priority Data

Jan. 17, 2001 (JP) ..... 2001-008867

(51) Int. Cl.[7] ..... G03G 9/08

(52) U.S. Cl. ..... 430/110.3; 430/108.1; 430/108.7; 430/111.4; 430/126

(58) Field of Search ..... 430/110.3, 108.1, 430/108.7, 111.4, 126

(56) References Cited

U.S. PATENT DOCUMENTS 6,187,497 B1 * 2/2001 Kushi et al. ..... 430/110
6,453,146 B1 * 9/2002 Yamada et al. ..... 399/350

FOREIGN PATENT DOCUMENTS

| | | | |
|---|---|---|---|
| JP | 62-184469 | A | 8/1987 |
| JP | 3-100661 | A | 4/1991 |
| JP | 5-34971 | A | 2/1993 |
| JP | 6-266152 | A | 9/1994 |
| JP | 6-308759 | A | 11/1994 |
| JP | 7-28276 | A | 1/1995 |
| JP | 8-115007 | A | 5/1996 |
| JP | 9-319134 | A | 12/1997 |
| JP | 10-312089 | A | 11/1998 |

* cited by examiner

*Primary Examiner*—John L Goodrow
(74) *Attorney, Agent, or Firm*—Oliff & Berridge, PLC

(57) ABSTRACT

In an electrophotographic developer and a process for forming an image, an electrophotographic toner used therein contains spherical toner parent particles and two or more kinds of inorganic particles having different average particle diameters, at least one kind of the inorganic fine particles being spherical particles having an average primary particle diameter of about 80 to 300 nm, and the inorganic particles containing the spherical particles being attached to the toner parent particles to provide a structure satisfying the following conditions (1) and (2):

(1) the spherical particles have a coverage on a surface of the toner parent particles of about 20% or more; and (2) a proportion of the inorganic particles that are separated from the toner parent particles upon dispersing the toner in an aqueous solution is about 35% or less of a total addition amount of the inorganic particles.

16 Claims, No Drawings

ELECTROPHOTOGRAPHIC TONER, ELECTROPHOTOGRAPHIC DEVELOPER AND PROCESS FOR FORMING IMAGE

BACKGROUND OF THE INVENTION

1. Field of the Invention

The present invention relates to an electrophotographic toner and an electrophotographic developer that are used for developing an electrostatic latent image in an electrophotographic process and an electrostatic recording process, and a process for forming an image.

2. Description of Related Art

In the electrophotographic process, an electrostatic latent image formed on a latent image holding member (photoreceptor) is developed with a toner containing a colorant, and the resulting toner image is transferred to a transfer material and then fixed with a heat roll to obtain an image. The latent image holding member is separately subjected to cleaning for the formation of another electrostatic latent image. A dry developer used in the electrophotographic process is roughly classified to a one-component developer employing solely a toner composed of a binder resin and a colorant and other materials, and a two-component developer formed by mixing the toner and a carrier. The one-component developer can be classified to a magnetic one-component developer using magnetic powder, which is fed to a latent image holding member by magnetic power for development, and a non-magnetic one-component developer using no magnetic powder, which is fed to a latent image holding member by application of charge with a charging roll for development. In the market of electrophotography in the last half of eighties, miniaturization and high performance are strongly demanded for digitalization, and particularly for a full color image, high image quality equivalent to sophisticated printing and silver halide photography is demanded.

Digital processing is essential for realizing high image quality, and the effect of the digital processing includes complicated image processing that can be carried out at high speed. According to the effect, characters and photographic images can be separately controlled, and reproducibility of qualities of them is greatly improved in comparison to the analog technology. In particular, it is important for photographic images that gradation correction and color correction become possible, and it is advantageous in gradation characteristics, fineness, sharpness, color reproducibility and graininess in comparison to the analog technology. It is necessary that an image as an image output must be produced strictly reflecting a latent image produced by an optical system, and therefore reduction in the particle diameter of toners is accelerated to aim for highly faithful reproducibility. However, it is difficult only by the reduction of the particle diameter of the toner that high image quality is stably obtained, and improvements of the fundamental characteristics in development, transferring and fixing characteristics are becoming important.

In particular, a color image is formed by superimposing toners of three or four colors. Therefore, when one of the toners exhibits such characteristics that are different from the initial characteristics or different from the characteristics of the toners of other colors from the standpoint of development, transfer and fixing, it suffers deterioration in image quality, such as reduction in color reproducibility, deterioration of graininess and formation color unevenness. It is important how to conduct stable control of the characteristics of the respective toners in order to maintain the stable image of high quality in the initial stage even when the time lapses. It has been reported that the toner is agitated in a developing device, which easily brings about change of microstructure on the toner surface, and the transfer property is largely changed (JP-A-10-312089).

It has been proposed to improve flowability, charging property and transfer property of a toner that the shape of the toner is approximated to a spherical shape (JP-A-62-184469). However, when the toner has a spherical shape, the following problems are liable to occur. A developing device is equipped with a feeding amount controlling plate for controlling the feeding amount of the developer to a constant amount, and the feeding amount can be controlled by changing the space between a magnetic roll and the feeding amount controlling plate. However, the flowability of the developer is increased by using the spherical toner, and the tapped bulk density thereof is increased. As a result, the developer is trapped at the part for controlling the feeding, and such a phenomenon occurs that the feeding amount becomes unstable. Although the feeding amount can be improved by controlling the surface roughness of the magnetic roll and decreasing the distance between the controlling plate and the magnetic roll, the packing phenomenon caused by trapping the developer is further intensified, and the stress applied to the toner is also increased corresponding to the phenomenon. Consequently, such a problem has been confirmed that the toner easily suffers change of the microstructure of the toner surface, particularly burying or separation of an external additive, whereby the developing characteristics and the transfer characteristics are greatly changed from those in the initial stage.

In order to solve the problem, it has been reported that the packing property is suppressed by combining a spherical toner and a non-spherical toner, so as to attain high image quality (JP-A-6-308759). However, although it is effective to suppress the packing property, the non-spherical toner is liable to remain as transfer residue, and a high transfer efficiency cannot be attained. Furthermore, in the case where development and recovering are simultaneously carried out, the proportion of the non-spherical toner is increased because of recovering the non-spherical toner as transfer residue to cause a problem where the transfer efficiency is further reduced.

It has been proposed in order to improve developing property, transfer property and cleaning property of a spherical toner that two kinds of inorganic fine particles having different average particle diameters, i.e., an average particle diameter of 5 nm or more but less than 20 nm and an average particle diameter of 20 nm or more but 40 nm or less, are used in combination and are added in a particular amount (JP-A-3-100661). While this exerts high developing property, transfer property and cleaning property in the initial stage, the stress applied to the toner cannot be relieved with the lapse of time, and burying or separation of an external additive easily occurs to change the developing property and the transfer property to a large extent from the initial stage.

On the other hand, there have been reports that the use of inorganic fine particles having a large particle diameter is effective to suppress burying of an external additive on a toner (JP-A-7-28276, JP-A-9-319134 and JP-A-10-312089). However, all the inorganic fine particles in the reports have a large specific gravity, and separation of the external additive is unavoidable due to the agitation stress when the size of the external additive is increased. Furthermore, because the inorganic fine particles do not have a complete spherical shape, it is difficult that the standing of the external additive cannot be controlled to a constant state when the inorganic fine particles are attached to the surface of the toner. Consequently, the techniques are insufficient because the miniature surface protrusions functioning as a spacer are fluctuated, and stress is concentrated selectively at the protrusions, whereby burying or separation of the external additive is accelerated.

A technique has been disclosed that organic fine particles having a diameter of from 50 to 200 nm are added to a toner in order to effectively exert the spacer function (JP-A-6-266152). The spacer function can be effectively exerted by using the organic fine particle in the initial stage. However, although the organic fine particles suffer less burying or separation upon stress with the lapse of time, it is difficult that the high spacer function is stably attained since the organic fine particles themselves are deformed. It is also considered to obtain the spacer effect by attaching a large amount of the organic fine particles to the surface of the toner or by using organic fine particles having a large particle diameter, but in these cases, the characteristics of the organic fine particles are largely reflected. In other words, they cause influences on the powder characteristics of the toner having inorganic fine particles added, such as inhibition of flowability and deterioration due to heat aggregation, and influences on the charging characteristics thereof, such as reduction of the degree of freedom on controlling the charging property due to the charge imparting capability of the organic fine particles themselves.

On the other hand, the surface structure of the toner is largely changed to vary the characteristics thereof not only by the property and the structure of the external additive but also by the method of external addition to the toner surface. In particular, a spherical toner largely changes the surface structure thereof by the method of external addition. In the case of an irregular toner, when an external additive once enters the depressions on the toner surface, the external additive is difficult to move even when blending is continued, and the external additive can easily increase the adhesion strength between the toner and the external additive at the same position thereof upon receiving share stress caused by contact of the toner particles owing to the low flowability thereof. However, in the case of the spherical toner, the external additive on the toner surface is movable owing to the absence of depression on the toner surface, and it is difficult to increase the adhesion strength between the toner and the external additive because share stress caused by contact of the toner particles is difficult to be applied owing to the high flowability thereof. In particular, these tendencies become remarkable when the particle diameter of the external additive is large. In view of the circumstances, a method has been proposed that Hybridizer (produced by Nara Machinery Co., Ltd.) is used as a method for attaching an external additive to a toner produced by a wet process, so as to firmly adhere the external additive to the toner surface (JP-A-5-34971). However, the external additive can be firmly adhered to the toner surface, but burying occurs in a large extent to reduce the function as a spacer, whereby the transfer performance is deteriorated.

In recent years, color printing, particularly on-demand printing, is being highly desired, and such a method has been reported that a multi-color image is formed on a transfer belt for high-speed duplication, and the multi-color image is transferred to an image fixing material all at once, followed by fixing (JP-A-8-115007). A transfer operation is repeated twice, i.e., the first transferring step of transferring the image from a photoreceptor to the transfer belt and the second transfer step of transferring the image from the transfer belt to the transfer material, and thus the importance of the technique for improving the transfer efficiency is being increased. Particularly, in the case of the second transferring step, because the multi-color image is transferred all at once, and various kinds of the transfer material is used (for example, the thickness and the surface property vary in the case of paper), it is necessary that the charging property, the developing property and the transfer property are highly controlled for decreasing the influence thereof.

While the toner parent particles are necessarily approximated to a spherical shape in order to attain a high transfer efficiency as described in the foregoing, a high transfer efficiency cannot be attained only by using the spherical toner parent particles upon considering the transfer efficiency with the lapse of time. When the spherical toner parent particles are used, inorganic fine particles are uniformly attached to the surface of the toner parent particles to reduce the adhesion force of the toner parent particles. However, with the lapse of time, the inorganic fine particles cannot contribute to the reduction of the adhesion force of the toner parent particles due to burying or separation of the inorganic fine particles on the surface, whereby the transfer efficiency and further the developing property are deteriorated with the lapse of time. In particular, there is such a problem that the inorganic fine particles on the surface are difficult to move due to the absence of depression on the surface of the spherical toner parent particles, and the inorganic fine particles are liable to be buried upon receiving stress. Furthermore, as described in the foregoing, organic fine particles, such as PMMA, suffer less burying and separation upon receiving stress with the lapse of time, but they have such a problem that the organic fine particles themselves are deformed.

SUMMARY OF THE INVENTION

Therefore, the invention has been developed to solve the problems associated with the conventional techniques and to provide an electrophotographic toner, an electrophotographic developer and a process for forming an image, in which the developing and transferring steps are stabilized with the lapse of time to obtain an image having high image quality that is particularly excellent in reproducibility and gradation property of neutral colors in a stable manner while the high transfer efficiency and the high image quality owing to the spherical toner parent particles are maintained.

According to an aspect of the invention, the electrophotographic toner contains toner parent particles having an average shape factor $ML^2/A$ in a range of about from 100 to 135 and two or more kinds of inorganic particles having different average particle diameters, at least one kind of the inorganic particles being spherical particles having an average primary particle diameter in a range of about 80 to 300 nm, and the inorganic fine particles containing the spherical particles being attached to the toner parent particles to provide a structure satisfying the following conditions (1) and (2):

(1) the spherical particles have a coverage on a surface of the toner parent particles of about 20% or more; and (2) a proportion of the inorganic particles that are separated from the toner parent particles upon dispersing the toner in an aqueous solution is about 35% or less of a total addition amount of the inorganic particles.

It is preferred in the electrophotographic toner of the invention that the toner parent particles have an average shape factor $ML^2/A$ in a range of about from 100 to 130.

It is preferred in the electrophotographic toner of the invention that the spherical particles have an average primary particle diameter in a range of about from 100 to 200 nm.

It is preferred in the electrophotographic toner of the invention that the spherical particles are formed of silica.

It is preferred in the electrophotographic toner of the invention that the spherical particles have the Wardell's sphericity ψ in a range of about from 0.8 to 1.0, and more preferably about from 0.85 to 1.0.

It is preferred in the electrophotographic toner of the invention that one kind of the inorganic particles has an average primary particle diameter in a range of about from 5 to 50 nm.

According to another aspect of the invention, the electrophotographic developer contains the electrophotographic toner of the invention and a carrier.

It is preferred in the electrophotographic developer of the invention that the spherical particles have an average primary particle diameter in a range of about from 100 to 200 nm.

It is preferred in the electrophotographic developer of the invention that the spherical particles are formed of silica.

It is preferred in the electrophotographic developer of the invention that the carrier contains a ferrite core.

It is preferred in the electrophotographic developer of the invention that the carrier has an average particle diameter in a range of about from 30 to 80 μm.

It is preferred in the electrophotographic developer of the invention that one kind of the inorganic particles has an average primary particle diameter in a range of about from 5 to 50 nm.

According to still another aspect of the invention, the process for forming an image contains the steps of:

forming an electrostatic latent image on a latent image holding member;

forming a developer layer containing a toner on a surface of a developer holding member arranged to face the latent image holding member;

developing the electrostatic latent image on the latent image holding member with the developer layer to form a toner image; and transferring the toner image thus developed to a transfer material, the toner being formed of the electrophotographic toner of the invention.

It is preferred in the process for forming an image of the invention that the spherical particles have an average primary particle diameter in a range of about from 100 to 200 nm.

It is preferred in the process for forming an image of the invention that the spherical particles are formed of silica.

It is preferred in the process for forming an image of the invention that the spherical particles have the Wardell's sphericity ψ in a range of about from 0.8 to 1.0.

DETAILED DESCRIPTION OF THE INVENTION

The invention will be described in detail below.

(Electrophotographic Toner)

The electrophotographic toner of the invention contains toner parent particles having an average shape factor $ML^2/A$ in a range of about from 100 to 135 and two or more kinds of inorganic particles having different particle diameters, in which at least one kind of the inorganic particles are spherical particles having an average primary particle diameter in a range of about 80 to 300 nm, and the inorganic particles containing the spherical particles are attached to the toner parent particles to provide a structure satisfying the following conditions (1) and (2):

(1) the spherical particles have a coverage on a surface of the toner parent particles of about 20% or more; and (2) a proportion of the inorganic particles that are separated from the toner parent particles upon dispersing the toner in an aqueous solution is about 35% or less of a total addition amount of the inorganic particles.

The electrophotographic toner of the invention uses, in addition to the spherical toner parent particles, spherical particles having a relatively large diameter and a spherical shape as one kind of the two or more kinds of inorganic particles having different average particle diameter, whereby the spherical particles can be difficult to be buried on the toner parent particles. Furthermore, the attachment structure of the inorganic particles containing the spherical particles and the toner parent particles is made to have the particular conditions to control the change of the surface structure of the toner parent particles with the lapse of time. As a result, high developing property and transfer property can be obtained, and an image excellent in reproducibility and gradation property of neutral colors can be obtained. Therefore, the developing and transferring steps are stabilized with the lapse of time to obtain an image having high image quality that is particularly excellent in reproducibility and gradation property of neutral colors in a stable manner while the high transfer efficiency and the high image quality owing to the spherical toner parent particles are maintained.

The inorganic particles will be described.

The inorganic particles contain two or more kinds of particles having different average particle diameter, one kind of which includes spherical particles having an average primary particle diameter of about 80 to 300 nm, and the attachment structure of the inorganic particles containing the spherical particles and the toner parent particles satisfies the foregoing conditions (1) and (2).

According to the condition (1), the spherical particles have coverage on the surface of the toner parent particles of about 20% or more, and more preferably 25% or more. Generally, in an ordinary process for obtaining a full color image, monochrome images are transferred from the latent image holding member to the intermediate transfer material one by one (primary transfer), and then the images are transferred to a transfer medium, such as paper, all at once (second transfer). When the toner surface coverage is less than 20%, it lowers the transfer efficiency in both the first transfer and the second transfer, and as a result, the image quality of the resulting print, particularly neutral colors and gradation property, is considerably lowered. When it exceeds 70%, on the other hand, it is not preferred since the spherical particles are liable to be transferred to the carrier or the photoreceptor, so as to cause problems where the image quality is deteriorated due to decrease of the charge of the developer and filming on the photoreceptor.

The coverage of the spherical particles on the surface of the toner parent particles can be obtained by subjecting a photograph of the toner to image analysis. Specifically, for example, an SEM photograph (magnification 10,000) of the toner is obtained by using a scanning electron microscope S4100 (produced by Hitachi, Ltd.) and then subjected to image analysis with an image analyzer Luzex III (produced by Nireco Corp.) to obtain the coverage of the spherical particles having an average primary particle diameter of about 80 to 300 nm on the surface of the toner parent particles.

According to the foregoing condition (2), the inorganic particles containing the spherical particles exhibit a proportion of the inorganic particles that are separated from the toner parent particles upon dispersing the toner in an aqueous solution is about 35% or less, and more preferably 30% or less, of a total addition amount of the inorganic particles. The separating amount of the inorganic particles exceeds about 35%, the inorganic particles remain as transfer residue of the first transfer even though the first transfer efficiency is high, and as a result, the second transfer efficiency is thus lowered. Furthermore, the inorganic particles remaining on the photoreceptor as transfer residue are accumulated on a cleaning blade. The accumulation of the inorganic particles causes filming to contaminate the photoreceptor and to damage the photoreceptor, and as a result, deterioration of the image quality upraises. When it is less than 5%, on the other hand, it is not preferred since the flowability and the aggregation property of the toner are liable to be deteriorated, and such a problem may arise that transportation failure of the toner and contamination inside the device due to dripping thereof occur.

The proportion of the inorganic particles separated from the toner parent particles upon dispersing the toner in an aqueous solution (herein after referred to as a separating amount of the inorganic fine particles) can be measured in the following manner. 2 g of the toner are added to 40 ml of a 0.2% aqueous solution of surfactant (polyoxyethylene(10) octyl phenyl ether) and dispersed until the toner are completely wetted with the aqueous solution. Specifically, after adding 2 g of toner, the mixture is stirred with a magnetic stirrer at 100 rpm for 5 minutes. The resulting dispersion is subjected to centrifugal separation at 3,000 rpm for 2 minutes on a centrifugal separator, and the supernatant is removed. Thereafter, ion exchanged water is added for dispersing again, and the dispersion is filtered with filter paper. The supernatant is dried by allowing to stand for one day at an ordinary temperature, and the dried matter was molded by compacting and subjected to measurement of a net intensity A of the constitutional element of the inorganic particles (i.e., Si for the case where the inorganic particles are silica) by fluorescent X-ray analysis. Separately, the toner itself is molded by compacting, and a net intensity B of the constitutional element of the inorganic particles (i.e., Si for the case where the inorganic particles are silica) by fluorescent X-ray analysis. Furthermore, depending on necessity, the toner parent particles are also molded by compacting, and a net intensity C of the constitutional element of the inorganic particles (i.e., Si for the case where the inorganic particles are silica) by fluorescent X-ray analysis. The separating amount of the inorganic fine particles can be calculated from the resulting values according to the following equation. In the case where the compositions of the two or more kinds of inorganic particles are different from each other, the separating amount of the inorganic particles is the sum of the separating amounts of respective kinds.

$$\text{Separating amount of inorganic particles } (\%) = ((\text{net intensity } B - \text{net intensity } A)/(\text{net intensity } B - \text{net intensity } C)) \times 100$$

In order to achieve the attachment structure of the inorganic particles containing the spherical particles and the toner parent particles satisfying the particular conditions, it is preferred that the inorganic particles containing the spherical particles and the toner parent particles are blending under taking the following factors into consideration. Generally, in order to attach the inorganic particles on the surface of the toner parent particles, a prescribed amount of the inorganic particles are added to the toner parent particles and then mixed with a dry blending machine, whereby the inorganic particles can be mechanically and electrostatically attached to the surface of the toner parent particles. The mechanical attachment strength of the toner parent particles and the inorganic particles can be controlled by the output power of the blending machine through friction among the toner parent particles and contact between an inner wall of a container and the toner parent particles. In the case of spherical toner parent particles, the increasing effect of the mechanical attachment strength of the inorganic particles to the surface of the toner parent particles caused by friction among the toner parent particles upon blending is small owing to the larger flowability of the toner parent particles than irregular toner parent particles. Therefore, when the inorganic particles are attached to the spherical toner parent particles under the same condition as the irregular toner parent particles, the attachment strength thereof becomes too small. This tendency becomes conspicuous when the inorganic particles used have a larger particle diameter. In view of the circumstances, when a Henschel mixer, for example, is used, the attachment structure of the inorganic particles containing the spherical particles can be made to satisfy the particular conditions by appropriately adjusting the shape and the peripheral velocity of the agitation blades and the mixing time.

As one example of measures from the materials for increasing the attachment strength, the dispersibility of the material itself can be increased. For example, particles having a spherical shape can be used rather than those of an irregular shape as similar to the case of the invention where the spherical particles are used as one kind of the inorganic particles. Furthermore, the dispersibility can be further increased by using silica as the inorganic particles (spherical particles) as described later.

The spherical particles have an average primary particle diameter of about 80 to 300 nm, and more preferably about from 100 to 200 nm. When the average primary particle diameter is less than about 80 nm, the spherical particles, such as silica, on the surface of the toner parent particles are buried with the lapse of time, and as a result, the transfer efficiency is difficult to be maintained. When it exceeds about 300 nm, the spherical particles are liable to be separated and are difficult to be uniformly attached on the surface of the toner parent particles in a stable manner, whereby it causes not only decrease of the transfer efficiency but also white contamination of the developing machine due to separation from the toner upon developing.

The spherical particles preferably have a spherical shape of the Wardell's sphericity $\psi$ of about from 0.8 to 1.0, and more preferably about from 0.85 to 1.0. When the Wardell's sphericity $\psi$ exceeds about 0.8, the dispersibility is lowered, and the attachment structure sometimes fails to satisfy the particular conditions.

The spherical particles are not particularly limited as far as they have an average primary particle diameter of about 80 to 300 nm and a spherical shape, and spherical silica is preferably used from the standpoint of dispersibility. The spherical silica may be either those produced by a dry process, such as a gas phase oxidation process using $SiCl_4$ as a raw material and a deflagration process utilizing oxidation of metallic Si, those produced by a sol-gel process using tetraalkoxysilane as a raw material, those produced by a wet process using silicate as a raw material, or a mixture of these kinds of spherical silica. It is preferred that the spherical silica preferably has been subjected to a hydrophobic treatment on the surface thereof. By carrying out the hydrophobic treatment, the dispersibility is improved, and the attachment structure on the surface of the toner parent particles can be easily controlled. Known hydrophobic treatment agents may be used, and specifically, representative examples thereof include methyltrichlorosilane, dimethyldichlorosilane, trimethylchlorosilane, phneyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phneyltriethoxysilane, diphenyldiethoxysilane, isobutyltrimethoxysilane, decyltrimethoxysilane, hexamethyldisilazane, N,O-bis(trimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxychlorohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane.

The inorganic particles contain two or more kinds thereof having different average particle diameters, and in addition to the spherical particles having an average primary particle diameter of about 80 to 300 nm, particles having either a larger diameter or a smaller diameter may be used. In particular, it is preferred that the spherical particles having an average primary particle diameter of about 80 to 300 nm are used in combination with particles having a smaller average primary particle diameter of about from 5 to 50 nm. By using the particles, the powder flowability of the toner parent particles can be easily improved, and the charge thereof can be easily controlled. As the particles having such functions, titanium oxide is preferred from the standpoint of suppression of the temperature and humidity dependence of the charge amount of the toner. It is preferred that the particles of titanium oxide have been subjected to a hydrophobic treatment on the surface thereof. By carrying out the hydrophobic treatment, the dispersibility is improved, and the flowability of the toner parent particles can be largely improved. Known hydrophobic treatment agents may be used, and specifically, representative examples thereof include methyltrichlorosilane, dimethyldichlorosilane, trimethylchlorosilane, phneyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phneyltriethoxysilane, diphenyldiethoxysilane, isobutyltrimethoxysilane, decyltrimethoxysilane, hexamethyldisilazane, N,O-bis (trimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxychlorohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane.

Two or more kinds of particles having different average particle diameters are used as the inorganic particles, and at this time, when the inorganic fine particle having a smaller diameter are attached to the toner parent particles, the flowability of the toner is improved, and as a result, the inorganic particles having a larger diameter are difficult to be uniformly attached thereon. Therefore, it is preferred that the inorganic particles having a smaller particle diameter are added after the addition of the inorganic particles having a larger diameter. In other words, in the case where the two or more kinds of inorganic particles having different particle diameters are used, the order of addition of them is preferably from the inorganic particles having the largest diameter to those having smaller diameter one by one.

The toner parent particles will be described.

The toner parent particles have an average shape factor $ML^2/A$ of about from 100 to 135, and they are necessarily approximated to a spherical shape for attaining a high transfer efficiency. The toner parent particles preferably have an average shape factor $ML^2/A$ of about from 100 to 135, and more preferably about from 100 to 130. When the average shape factor $ML^2/A$ exceeds about 135, the transfer efficiency is lowered, and deterioration in image quality of a printed sample can be confirmed with the naked eye.

The toner parent particles contain at least a binder resin and a colorant. The toner parent particles may be preferably particles having a volume average diameter of from 2 to 12 μm, and more preferably from 3 to 9 μm.

Examples of the binder resin include homopolymers and copolymers of a styrene compound, such as styrene and chlorostyrene, a monoolefin, such as ethylene, propylene, butylene and isoprene, a vinyl ester, such as vinyl acetate, vinyl propionate, vinyl benzoate and vinyl butyrate, an α-methylene aliphatic monocarboxylate, such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, a vinyl ether, such as vinyl methyl ether, vinyl ethyl ether and vinyl butyl ether, and a vinyl ketone, such as vinyl methyl ketone, vinyl hexyl ketone and vinyl isopropenyl ketone. In particular, representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene. Furthermore, polyester, polyurethane, an epoxy resin, a silicone resin, polyamide, modified rosin and paraffin wax can also be exemplified.

Representative examples of the colorant include magnetic powder, such as magnetite and ferrite, carbon black, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 12, C.I. Pigment Yellow 17, C.I. Pigment Yellow 97, C.I. Pigment Yellow 128, C.I. Pigment Yellow 151, C.I. Pigment Yellow 155, C.I. Pigment Yellow 173, C.I. Pigment Yellow 180, C.I. Pigment Yellow 185, C.I. Pigment Blue 15:1 and C.I. Pigment Blue 15:3.

Known additives, such as a charge controlling agent, a releasing agent and other inorganic particles, may be added to the toner parent particles through an internal addition treatment or an external addition treatment.

Representative examples of the releasing agent include low molecular weight polyethylene, low molecular weight polypropylene, Fischer-Tropsch wax, montan wax, carnauba wax, rice wax and candelilla wax.

The charge controlling agent may be known products, and an azo metallic complex compound, a metallic complex compound of salicylic acid and a resin type charge controlling agent containing a polar group may be used. In the case where the toner is produced by a wet process, materials difficult to be dissolved in water are preferably used from the standpoint of control of the ion intensity and suppression of waste water pollution.

As the other inorganic particles, inorganic particles having a small diameter of 40 nm or less may be used for improving the powder flowability and the charge controllability, and depending on necessity, inorganic or organic fine particles having a larger diameter than them may also be used in combination for reducing the attachment strength. Known inorganic particles may be used as the other inorganic particles. Examples thereof include silica, alumina, titania, metatitanic acid, zinc oxide, zirconia, magnesia, calcium carbonate, magnesium carbonate, calcium phosphate, cerium oxide and strontium titanate. It is effective that the inorganic particles having a small diameter are subjected to a surface treatment because the dispersibility is increased to improve the powder flowability to a large extent.

The toner parent particles are not particularly limited from the production process thereof and can be obtained by known processes. Specific examples of the production process include a kneading and pulverization process, in which a binder resin and a colorant, with depending on necessity a releasing agent and a charge controlling agent, are mixed, pulverized and classified; a process, in which the shape of the particles obtained by the kneading and pulverization process is changed by applying a mechanical impact or heat energy; an emulsion polymerization and aggregation process, in which a dispersion formed by emulsion polymerization of a polymerizable monomer for obtaining a binder resin, is mixed with a colorant, depending on necessity a releasing agent and a charge controlling agent, and the mixture is aggregated and fused by heat to obtain the toner parent particles; a suspension polymerization process, in which a solution of a polymerizable monomer for obtaining a binder resin and a colorant with depending on necessity a releasing agent and a charge controlling agent is suspended in an aqueous solvent and polymerized; and a dissolution suspension process, in which a solution of a binder resin and a colorant with depending on necessity a releasing agent and a charge controlling agent is suspended in an aqueous solvent and granulated. Such a production process can also be employed that the toner parent particles obtained in the foregoing processes are used as a core, and aggregated particles are attached thereto, followed by heat fusing, so as to provide a core-shell structure. Upon adding an external additive, the toner parent particles and the external additive can be mixed, for example, in a Henschel mixer or a V-blender. In the case where the toner parent particles are produced by a wet process, the external addition can be carried out in a wet process.

The electrophotographic toner of the invention can be obtained by mixing the toner parent particles and the inorganic particles. The process for mixing (blending) is not particularly limited, and known processes can be employed. For example, a dry process using a Henschel mixer, a Q type mixer and a hybridization system may be used, and in the case where the toner parent particles are produced by a wet process, they may be continuously blended by the wet process. In order to remove coarse powder formed on blending, classification is preferably carried out after the blending process. At this time, the mixing process is carried out in such a manner that the attachment structure of the inorganic particles containing the spherical particles and the toner parent particles satisfies the particular conditions. The electrophotographic toner of the invention may contain a known cleaning assisting material depending on necessity.

(Electrophotographic Developer)

The electrophotographic developer of the invention contains the electrophotographic toner described in the foregoing and a carrier. Examples of the carrier include iron powder, glass beads, ferrite powder, nickel powder and powder formed by coating a resin on the surface of the powder. The mixing ratio of the electrophotographic toner and the carrier can be appropriately determined. Because the electrophotographic developer of the invention uses the electrophotographic toner of the invention, the developing and transferring steps are stabilized with the lapse of time to obtain an image having high image quality that is particularly excellent in reproducibility and gradation property of neutral colors in a stable manner while the high transfer efficiency and the high image quality owing to the spherical toner parent particles are maintained.

(Process for Forming Image)

The process for forming an image of the invention at least contains the steps of: forming an electrostatic latent image on a latent image holding member; forming a developer layer containing a toner on a surface of a developer holding member arranged to face the latent image holding member; developing the electrostatic latent image on the latent image holding member with the developer layer to form a toner image; and transferring the toner image thus developed to a transfer material, in which the toner is formed of the electrophotographic toner of the invention. In particular, it is preferred that the transferring step has a first transferring step of transferring the toner image thus developed to an intermediate transfer material, and a second transferring step of transferring the toner image transferred to the intermediate transfer material to the transfer material. The process for forming an image of the invention is a process for forming a full color image by accumulating toner images of four colors, i.e., cyan, magenta, yellow and black, on the transfer material, and it is preferred that the toner image of at least one color among the four colors is formed of the electrophotographic toner of the invention. Because the process for forming an image of the invention uses the electrophotographic toner of the invention, the developing and transferring steps are stabilized with the lapse of time to obtain an image having high image quality that is particularly excellent in reproducibility and gradation property of neutral colors in a stable manner while the high transfer efficiency and the high image quality owing to the spherical toner parent particles are maintained.

The process for forming an image of the invention can be carried out according to a conventionally known process without any particular limitation. Specific examples of an apparatus for forming an image, to which the process for forming an image of the invention can be applied, include an ordinary monochrome image forming apparatus containing only a single color toner in a developing device, a color image forming apparatus, in which toner images carried on a image holding member are transferred as a first transfer step to an intermediate transfer material one by one, and a tandem color image forming apparatus, in which two or more image holding members having developing devices of the colors, respectively, are arranged in serial on an intermediate transfer material.

EXAMPLES

The invention will be described in more detail with reference to the following examples, but the invention is not construed as being limited thereto. In the following description, all "parts" mean "parts by weight" unless otherwise indicated.

The measurements in the examples and the comparative examples are carried out in the following manner.

<Particle Size Distribution (Volume Average Particle Diameter (D50)>

The particle size distribution is measured by using Multisizer (produced by Nikkaki Co., Ltd.) with an aperture diameter of 100 $\mu$m.

<Average Shape Factor $ML^2/A$>

The average shape factor $ML^2/A$ is a value calculated by the following equation, and in the case of true sphere, $ML^2/A=100$:

$$ML^2/A=(\text{maximum length})^2\times\pi\times100/((\text{area})\times4)$$

As a specific measure for obtaining the average shape factor, a toner image is imported from an optical microscope to an image analyzer (LUZEX III produced by Nireco Corp.) to measure the diameter corresponding to a circle, and the shape factors of the respective particles are obtained from the maximum length and the area by the equation.

<Separating Amount of Inorganic Particles>

The separating amount of the inorganic particles is measured according to the method described in the foregoing using a fluorescent X-ray analyzer, XRF1500 (produced by Shimadzu Corp.).

<Surface Coverage of Inorganic Particles on Surface of Toner Parent Particles>

The surface coverage of the inorganic particles on the surface of the toner parent particles is measured according to the method described in the foregoing using a scanning electron microscope, S4100 (produced by Hitachi, Ltd.), and an image analyzer (LUZEX III produced by Nireco Corp.).

<Sphericity $\psi$ of Spherical Particles>

As the sphericity $\psi$, the Wardell's sphericity is employed, which is obtained by dividing the surface area of a sphere having the same volume as the actual particles by the surface area of the actual particles. The surface area of the sphere having the same volume as the actual particles can be obtained by arithmetic calculation from the average particle diameter of the toner. In order to obtain the surface area of the actual particles, the BET specific surface area is measured by using a powder specific surface area measuring apparatus, SS-100 (produced by Shimadzu Corp.), which is used as the surface area of the actual particles.

<Measurement of Charge Value>

A developer on a magnet sleeve in the developing device is sampled, and the charge value is measured by TB200 (produced by Toshiba Corp.)

<Image Density>

The image density is measured by using X-Rite 404A.

[Production of Toner Parent Particles]

Preparation of Resin Fine Particle Dispersion

A solution obtained by mixing and dissolving 370 of styrene, 30 g of n-butyl acrylate, 8 g of acrylic acid, 24 g of dodecanethiol and 4 g of carbon tetrabromide is emulsion-polymerized in a flask containing 550 g of ion exchanged water having 6 g of a nonionic surfactant (Nonipole 400 produced by Sanyo Chemicals Co., Ltd.) and 10 g of an anionic surfactant (Neogen SC produced by Daiichi Kogyo Seiyaku Co., Ltd.) dissolved therein, and 50 g of ion exchanged water having 4 g of ammonium persulfate dissolved therein are added thereto under slowly mixing over 10 minutes. After substituted with nitrogen, the content of the flask is heated to 70° C. under stirring on an oil bath, and the emulsion polymerization is continued for 5 hours. As a result, a resin fine particle dispersion having dispersed therein resin particles having an average particle diameter of 150 nm, a glass transition point Tg of 58° C. and a weight average molecular weight Mw of 11,500 is obtained. The dispersion has a solid concentration of 40% by weight.

| Preparation of colorant dispersion (1) | |
|---|---|
| Carbon black (Mogal L, produced by Cabot Corp.) | 60 g |
| Nonionic surfactant (Nonipole 400 produced by Sanyo Chemicals Co., Ltd.) | 6 g |
| Ion exchanged water | 240 g |

The foregoing components are mixed and dissolved under agitation by using a homogenizer (Ultra Turrax T50, produced by IKA Works Inc.) for 10 minutes, and thereafter the resulting mixture is subjected to a dispersion treatment in Altimizer to prepare a colorant dispersion (1) having colorant (carbon black) particles having an average particle diameter of 250 nm dispersed therein.

| Preparation of colorant dispersion (2) | |
|---|---|
| Cyan (C.I. Pigment Blue 15:3) | 60 g |
| Nonionic surfactant (Nonipole 400 produced by Sanyo Chemicals Co., Ltd.) | 5 g |
| Ion exchanged water | 240 g |

The foregoing components are mixed and dissolved under agitation by using a homogenizer (Ultra Turrax T50, produced by IKA Works Inc.) for 10 minutes, and thereafter the resulting mixture is subjected to a dispersion treatment in Altimizer to prepare a colorant dispersion (2) having colorant (cyan pigment) particles having an average particle diameter of 250 nm dispersed therein.

| Preparation of colorant dispersion (3) | |
|---|---|
| Magenta (C.I. Pigment Red 122) | 60 g |
| Nonionic surfactant (Nonipole 400 produced by Sanyo Chemicals Co., Ltd.) | 5 g |
| Ion exchanged water | 240 g |

The foregoing components are mixed and dissolved under agitation by using a homogenizer (Ultra Turrax T50, produced by IKA Works Inc.) for 10 minutes, and thereafter the resulting mixture is subjected to a dispersion treatment in Altimizer to prepare a colorant dispersion (3) having colorant (magenta pigment) particles having an average particle diameter of 250 nm dispersed therein.

| Preparation of colorant dispersion (4) | |
|---|---|
| Yellow (C.I. Pigment Yellow 180) | 90 g |
| Nonionic surfactant (Nonipole 400 produced by Sanyo Chemicals Co., Ltd.) | 5 g |
| Ion exchanged water | 240 g |

The foregoing components are mixed and dissolved under agitation by using a homogenizer (Ultra Turrax T50, produced by IKA Works Inc.) for 10 minutes, and thereafter the resulting mixture is subjected to a dispersion treatment in Altimizer to prepare a colorant dispersion (4) having colorant (yellow pigment) particles having an average particle diameter of 250 nm dispersed therein.

| Releasing agent dispersion | |
|---|---|
| Paraffin wax (HNP0190, produced by Nippon Seiro Co., Ltd., melting point: 85° C.) | 100 g |
| Cationic surfactant (Sanisol B50, produced by Kao Corp.) | 5 g |
| Ion exchanged water | 240 g |

The foregoing components are dispersed in a stainless steel round bottom flask by using a homogenizer (Ultra Turrax T50, produced by IKA Works Inc.) for 10 minutes, and thereafter the resulting mixture is subjected to a dispersion treatment in a pressure discharge homogenizer to prepare a releasing agent dispersion having releasing agent particles having an average particle diameter of 550 nm dispersed therein.

| Preparation of toner parent particles K1 | |
|---|---|
| Resin fine particle dispersion | 234 parts |
| Colorant dispersion (1) | 30 parts |
| Releasing agent dispersion | 40 parts |
| Polyaluminum chloride (PAC100W, produced by Asada Chemical Industries, Ltd.) | 1.8 parts |
| Ion exchanged water | 600 parts |

The foregoing components are mixed and dispersed in a stainless steel round bottom flask by using a homogenizer (Ultra Turrax T50, produced by IKA Works Inc.), and heated to 50° C. on an oil bath for heating under stirring the content of the flask. After maintaining at 50° C. for 30 minutes, it is confirmed that aggregated particles having D50 of 4.5 μm are formed. The temperature of the oil bath is increased to maintain at 56° C. for 1 hour, and the D50 becomes 5.3 μm. Thereafter, 26 parts of the resin fine dispersion is added to the dispersion containing the aggregated particles, and then the temperature of the oil bath is increased to 50° C. and maintained for 30 minutes. A 1N sodium hydroxide solution is added to the dispersion containing the aggregated particles to adjust the pH of the system to 5.0, and then the stainless steel flask is sealed and heated to 95° C. under continuous stirring using a magnetic seal, followed by maintaining for 4 hours. After cooling, the toner parent particles thus formed are filtered off and washed with ion exchanged water for four times, and toner parent particles K1 are obtained by freeze-drying. The toner parent particles K1 have D50 of 6.0 μm and an average shape factor $ML^2/A$ of 116.

Preparation of Toner Parent Particles C1

Toner parent particles C1 are obtained in the same manner as in the preparation of the toner parent particles K1 except that the colorant particle dispersion (2) is used instead of the colorant particle dispersion (1). The toner parent particles C1 have D50 of 5.7 μm and an average shape factor $ML^2/A$ of 117.

Preparation of Toner Parent Particles M1

Toner parent particles M1 are obtained in the same manner as in the preparation of the toner parent particles K1 except that the colorant particle dispersion (3) is used instead of the colorant particle dispersion (1). The toner parent particles M1 have D50 of 5.5 μm and an average shape factor $ML^2/A$ of 120.

Preparation of Toner Parent Particles Y1

Toner parent particles Y1 are obtained in the same manner as in the preparation of the toner parent particles K1 except that the colorant particle dispersion (4) is used instead of the colorant particle dispersion (1). The toner parent particles Y1 have D50 of 5.9 μm and an average shape factor $ML^2/A$ of 113.

| Preparation of toner parent particles K2 | |
|---|---|
| Resin fine particle dispersion | 234 parts |
| Colorant dispersion (1) | 30 parts |
| Releasing agent dispersion | 40 parts |
| Polyaluminum chloride (PAC100W, produced by Asada Chemical Industries, Ltd.) | 1.8 parts |
| Ion exchanged water | 600 parts |

The foregoing components are mixed and dispersed in a stainless steel round bottom flask by using a homogenizer (Ultra Turrax T50, produced by IKA Works Inc.), and heated to 50° C. on an oil bath for heating under stirring the content of the flask. After maintaining at 50° C. for 30 minutes, it is confirmed that aggregated particles having D50 of 4.5 μm are formed. The temperature of the oil bath is increased to maintain at 56° C. for 1 hour, and the D50 becomes 5.3 μm. Thereafter, 26 parts of the resin fine dispersion is added to the dispersion containing the aggregated particles, and then the temperature of the oil bath is increased to 50° C. and maintained for 30 minutes. After adding a 1N sodium hydroxide solution to the dispersion containing the aggregated particles to adjust the pH of the system to 5.0, 11.3 parts of a silica dispersion (produced by a wet process, average primary particle diameter: 150 nm, solid concentration: 40%) is added thereto, and then the stainless steel flask is sealed and heated to 95° C. under continuous stirring using a magnetic seal, followed by maintaining for 4 hours. After cooling, the toner parent particles thus formed are filtered off and washed with ion exchanged water for four times, and toner parent particles K2 are obtained by freeze-drying. The toner parent particles K2 have D50 of 6.2 μm and an average shape factor $ML^2/A$ of 120.

Preparation of Toner Parent Particles C2

Toner parent particles C2 are obtained in the same manner as in the preparation of the toner parent particles K2 except that the colorant particle dispersion (2) is used instead of the colorant particle dispersion (1). The toner parent particles C2 have D50 of 5.8 μm and an average shape factor $ML^2/A$ of 119.

Preparation of Toner Parent Particles M2

Toner parent particles M2 are obtained in the same manner as in the preparation of the toner parent particles K2 except that the colorant particle dispersion (3) is used instead of the colorant particle dispersion (1). The toner parent particles M2 have D50 of 5.7 μm and an average shape factor $ML^2/A$ of 122.

Preparation of Toner Parent Particles Y2

Toner parent particles Y2 are obtained in the same manner as in the preparation of the toner parent particles K2 except that the colorant particle dispersion (4) is used instead of the colorant particle dispersion (1). The toner parent particles Y2 have D50 of 5.7 μm and an average shape factor $ML^2/A$ of 115.

| Production of carrier | |
|---|---|
| Ferrite particles (average diameter: 50 μm) | 100 parts |
| Toluene | 14 parts |
| Styrene-methyl methacrylate copolymer (compositional ratio: 90/10) | 2 parts |
| Carbon black (R330, produced by Cabot Corp.) | 0.2 part |

The foregoing components except for the ferrite particles are stirred by a stirrer for 10 minutes to prepare a dispersed coating composition. The coating composition and the ferrite particles are put in a vacuum deaeration kneader and stirred at 60° C. for 30 minutes, and the contents are deaerated by decreasing the pressure under heating, followed by drying, so as to obtain a carrier. The carrier has a volume resistivity upon application of an electric field of 1,000 V/cm of $10^{11}$ Ω·cm.

Example 1

2.5 parts of spherical silica (produced by the sol-gel process and subjected to a hexamethyldisilazan treatment, average primary particle diameter: 140 nm, sphericity ψ: 0.90) is added to 100 parts each of the toner parent particles K1, C1, M1 and Y1, and blended in a 20L Henschel mixer at a peripheral velocity of 40 m/s for 10 minutes. Thereafter, 1.2 parts of rutile type titanium oxide (subjected to an n-decyltrimethoxysilane treatment, primary particle diameter: 20 nm) is further added thereto and blended at a peripheral velocity of 40 m/s for 5 minutes. Coarse particles are then removed by using a sieve having a mesh of 45 μm to obtain a toner. The coverage of the spherical silica on the surface of the toner C1 is 33.1%, and the separating amount of the spherical silica after dispersing in an aqueous solution is 18.2%. The separating amount of titanium oxide is 2.0%, and the separating amount of the inorganic particles is 20.2%.

100 parts of the carrier and 5 parts of the toner thus obtained are mixed in a V-blender at 40 rpm for 20 minutes and classified with a sieve having a mesh of 212 μm, so as to obtain a developer.

Example 2

1.5 parts of spherical silica (produced by the deflagration process and subjected to a silicone oil treatment, average primary particle diameter: 100 nm, sphericity ψ: 0.85) is added to 100 parts each of the toner parent particles K1, C1, M1 and Y1, and blended in a 20L Henschel mixer at a peripheral velocity of 45 m/s for 10 minutes. Thereafter, 1 part of anatase type titanium oxide (subjected to an i-butyltrimethoxysilane treatment, primary particle diameter: 20 nm) is further added thereto and blended at a peripheral velocity of 45 m/s for 5 minutes. Coarse particles are then removed by using a sieve having a mesh of 45 μm to obtain a toner. The coverage of the spherical silica on the surface of the toner C1 is 25.0%, and the separating amount of the spherical silica after dispersing in an aqueous solution is 13.1%. The separating amount of titanium oxide is 0.8%, and the separating amount of the inorganic particles is 13.9%.

100 parts of the carrier and 5 parts of the toner thus obtained are mixed in a V-blender at 40 rpm for 20 minutes and classified with a sieve having a mesh of 212 μm, so as to obtain a developer.

Example 3

2.0 parts of spherical silica (produced by the sol-gel process and subjected to an n-decyltrimethoxysilane treatment, average primary particle diameter: 200 nm, sphericity ψ: 0.90) is added to 100 parts each of the toner parent particles K1, C1, M1 and Y1, and blended in a 20L Henschel mixer at a peripheral velocity of 50 m/s for 10 minutes. Thereafter, 1 part of anatase type titanium oxide (subjected to an n-decyltrimethoxysilane treatment, average primary particle diameter: 30 nm) is further added thereto and blended at a peripheral velocity of 50 m/s for 5 minutes. Coarse particles are then removed by using a sieve having a mesh of 45 μm to obtain a toner. The coverage of the spherical silica on the surface of the toner C1 is 21.0%, and the separating amount of the spherical silica after dispersing in an aqueous solution is 30.0%. The separating amount of titanium oxide is 0.1%, and the separating amount of the inorganic particles is 30.1%.

100 parts of the carrier and 5 parts of the toner thus obtained are mixed in a V-blender at 40 rpm for 20 minutes and classified with a sieve having a mesh of 212 μm, so as to obtain a developer.

Example 4

2.0 parts of spherical silica (produced by the sol-gel process and subjected to an n-decyltrimethoxysilane treatment, average primary particle diameter: 200 nm, sphericity ψ: 0.95) is added to 100 parts each of the toner parent particles K2, C2, M2 and Y2, and blended in a 20L Henschel mixer at a peripheral velocity of 50 m/s for 10 minutes. Thereafter, 1.2 parts of rutile type titanium oxide (subjected to an n-decyltrimethoxysilane treatment, average primary particle diameter: 20 nm) is further added thereto and blended at a peripheral velocity of 40 m/s for 5 minutes. Coarse particles are then removed by using a sieve having a mesh of 45 μm to obtain a toner. The coverage of the spherical silica on the surface of the toner C2 is 30.2%, and the separating amount of the spherical silica after dispersing in an aqueous solution is 15.7%. The separating amount of titanium oxide is 2.5%, and the separating amount of the inorganic particles is 18.2%.

100 parts of the carrier and 5 parts of the toner thus obtained are mixed in a V-blender at 40 rpm for 20 minutes and classified with a sieve having a mesh of 212 μm, so as to obtain a developer.

Comparative Example 1

3.4 parts of spherical silica (produced by the sol-gel process and subjected to a hexamethyldisilazane treatment, average primary particle diameter: 200 nm, sphericity ψ: 0.90) and 1 part of anatase type titanium oxide (subjected to an n-decyltrimethoxysilane treatment, average primary particle diameter: 20 nm) are added to 100 parts each of the toner parent particles K1, C1, M1 and Y1, and blended in a 20L Henschel mixer at a peripheral velocity of 30 m/s for 10 minutes. Thereafter, coarse particles are then removed by using a sieve having a mesh of 45 μm to obtain a toner. The coverage of the spherical silica on the surface of the toner C1 is 28.5%, and the separating amount of the spherical silica after dispersing in an aqueous solution is 30.4%. The separating amount of titanium oxide is 7.2%, and the separating amount of the inorganic particles is 37.6%.

100 parts of the carrier and 5 parts of the toner thus obtained are mixed in a V-blender at 40 rpm for 20 minutes and classified with a sieve having a mesh of 212 μm, so as to obtain a developer.

Comparative Example 2

1 part of spherical silica (produced by the deflagration process and subjected to a silicone oil treatment, average primary particle diameter: 100 nm, sphericity ip: 0.85) is added to 100 parts each of the toner parent particles K1, C1, M1 and Y1, and blended in a 20L Henschel mixer at a peripheral velocity of 45 m/s for 10 minutes. Thereafter, 1 part of rutile type titanium oxide (subjected to an n-decyltrimethoxysilane treatment, average primary particle diameter: 20 nm) is further added thereto and blended at a peripheral velocity of 45 m/s for 5 minutes. Coarse particles are then removed by using a sieve having a mesh of 45 μm to obtain a toner. The coverage of the spherical silica on the surface of the toner C1 is 18.0%, and the separating amount of the spherical silica after dispersing in an aqueous solution is 10.2%. The separating amount of titanium oxide is 1.0%, and the separating amount of the inorganic particles is 11.2%.

100 parts of the carrier and 5 parts of the toner thus obtained are mixed in a V-blender at 40 rpm for 20 minutes and classified with a sieve having a mesh of 212 μm, so as to obtain a developer.

Comparative Example 3

1 part of anatase type titanium oxide (subjected to an i-butyltrimethoxysilane treatment, average primary particle diameter: 20 nm) is added to 100 parts each of the toner parent particles K1, C1, M1 and Y1, and blended in a 20L Henschel mixer at a peripheral velocity of 40 m/s for 5 minutes. Thereafter, 2.5 parts of spherical silica (produced by the sol-gel process and subjected to a hexamethyldisilazane treatment, average primary particle diameter: 200 nm, sphericity ψ: 0.90) is further added thereto and blended at a peripheral velocity of 40 m/s for 10 minutes. Coarse particles are then removed by using a sieve having a mesh of 45 μm to obtain a toner. The coverage of the spherical silica on the surface of the toner C1 is 19.0%, and the separating amount of the spherical silica after dispersing in an aqueous solution is 36.2%. The separating amount of titanium oxide is 0.1%, and the separating amount of the inorganic particles is 36.3%.

100 parts of the carrier and 5 parts of the toner thus obtained are mixed in a V-blender at 40 rpm for 20 minutes and classified with a sieve having a mesh of 212 μm, so as to obtain a developer.

Comparative Example 4

1.5 parts of spherical silica (produced by the deflagration process and subjected to a silicone oil treatment, average primary particle diameter: 100 nm, sphericity ψ: 0.85) is added to 100 parts each of the toner parent particles K1, C1, M1 and Y1, and blended by a Hybridization system, Model NHS-1, at a peripheral velocity of 70 m/s for 2 minutes. Thereafter, 1 part of rutile type titanium oxide (subjected to an n-decyltrimethoxysilane treatment, average primary particle diameter: 20 nm) is further added thereto and blended in a 5L Henschel mixer at a peripheral velocity of 33 m/s for 5 minutes. Coarse particles are then removed by using a sieve having a mesh of 45 μm to obtain a toner. The coverage of the spherical silica on the surface of the toner C1 is 17.5%, and the separating amount of the spherical silica after dispersing in an aqueous solution is 8.1%. The separating amount of titanium oxide is 12.0%, and the separating amount of the inorganic particles is 20.1%.

100 parts of the carrier and 5 parts of the toner thus obtained are mixed in a V-blender at 40 rpm for 20 minutes and classified with a sieve having a mesh of 212 μm, so as to obtain a developer.

Comparative Example 5

A toner is obtained in the same manner as in Example 1 except that spherical silica (produced by the gas phase oxidation process and subjected to a hexamethyldisilazane treatment, sphericity ψ: 0.85) is used instead of the spherical silica (produced by the sol-gel process and subjected to a hexamethyldisilazan treatment, average primary particle diameter: 140 nm, sphericity ψ: 0.90). The coverage of the spherical silica on the surface of the toner C1 is 35.0%, and the separating amount of the spherical silica after dispersing in an aqueous solution is 15.0%. The separating amount of titanium oxide is 2.3%, and the separating amount of the inorganic particles is 17.3%.

100 parts of the carrier and 5 parts of the toner thus obtained are mixed in a V-blender at 40 rpm for 20 minutes and classified with a sieve having a mesh of 212 μm, so as to obtain a developer.

(Evaluation)

The developers of Examples and Comparative Examples are subjected to the following evaluations. The results of the evaluations are shown in Table 1.

[Evaluation of Transfer Property]

Efficiencies of the first transfer and the second transfer are evaluated by using the developer using the cyan toner with DocuColor 1250 (produced by Fuji Xerox Co., Ltd.) in an environment of 20° C. 50% RH. A solid patch of 5 cm×2 cm is developed, and the weight (W1) thereof is measured by transferring the developed image on a photoreceptor to a tape. Separately, the same solid patch is transferred to an intermediate transfer material, and the weight (W2) of the transferred image is measured. Furthermore, the same solid patch is transferred to paper (J paper, produced by Fuji Xerox Office Supply Co., Ltd.), and the weight (W3) of the transferred image is measured. The efficiencies of the first transfer and the second transfer are determined by the following equation to evaluate the transfer property.

$$\text{(First transfer efficiency)}=W2/W1\times100(\%)$$

$$\text{(Second transfer efficiency)}=W3//W2\times100(\%)$$

The evaluation conditions are a first transfer current of 20 μA and a second transfer voltage of 1.5 kV. The evaluation is carried out by printing in a black mode with the developing device arranged at the black position. The evaluation standard is as follows.

A: first and second transfer efficiencies of 97% or more

B: first and second transfer efficiencies of 95% or more but less than 97%

C: first and second transfer efficiencies of less than 95%

[Evaluation of Time Lapse Property (Secondary Failure)]

A printing test for 30,000 sheets is carried out by using the developers of four colors with DocuColor 1250 (produced by Fuji Xerox Co., Ltd.) in an environment of 20° C. 50% RH, and the image quality in the initial stage and the image quality after the lapse of time (after printing 30,000 sheets) are evaluated. At this time, the distance between a tip end of a metallic plate of a cleaning blade and a tip end of rubber (i.e., the extrusion amount of rubber), which is 10 mm in the original machine, is changed to 7.5 mm, and the length of the metallic plate is increased in the corresponding amount. The evaluation standard is as follows.

A: no attachment found on photoreceptor, and no deterioration of image quality

B: attachment found on photoreceptor, but no problem on image quality

C: attachment found on photoreceptor and printed out to deteriorate image quality The reproducibility and the gradation property of neutral colors are also evaluated for the image quality in the initial stage and the image quality after the lapse of time (after printing 30,000 sheets).

Half-tone images of image densities of 10%, 30% and 50% are formed, and the reproducibility and the gradation property of neutral colors are evaluated with the naked eye. The evaluation standard is as follows.

A: no unevenness found in all images of image densities of 10%, 30% and 50%

C: unevenness found in at least one of images of image densities of 10%, 30% and 50%

TABLE 1

| | Evaluation of transfer property | | | | Evaluation of time lapse property | | |
|---|---|---|---|---|---|---|---|
| | First transfer efficiency (%) | Second transfer efficiency (%) | Image quality in initial stage | Image quality after lapse of time | Reproducibility and gradation property of neutral colors in initial stage | Reproducibility and gradation property of neutral colors after lapse of time | Remarks |
| Example 1 | 99.8 A | 99.5 A | A | A | A | A | — |
| Example 2 | 97.3 A | 98.2 A | A | A | A | A | — |
| Example 3 | 95.1 B | 95.8 B | A | B | A | A | slight filming on photoreceptor |
| Example 4 | 98.6 A | 99.1 A | A | A | A | A | — |
| Comparative Example 1 | 98.1 A | 97.1 A | A | C | C | C | filming formed on entire photoreceptor |
| Comparative Example 2 | 93.8 C | 95.2 B | C | C | C | C | deterioration in image quality due to transfer unevenness occurring in initial stage |
| Comparative Example 3 | 94.3 C | 92.8 C | C | C | C | C | filming formed on photoreceptor |
| Comparative Example 4 | 92.1 C | 95.4 B | C | C | C | C | deterioration in image quality due to transfer unevenness occurring in initial stage |
| Comparative Example 5 | 99.5 A | 99.4 A | A | C | A | C | transfer unevenness gradually increased to cause deterioration in image quality |

It is understood from Examples and Comparative Examples that the transfer property and the transfer maintenance property can be improved, and contamination of the photoreceptor can be suppressed, so as to maintain an image having high image quality particularly excellent in reproducibility and gradation property of neutral colors, according to the invention, in which the spherical toner parent particles and two or more kinds of inorganic particles having different particle diameters as an external additive are contained where spherical silica having a relatively large diameter is used as one kind of the inorganic particles, and the attachment structure of the inorganic particles and the toner parent particles is controlled to satisfy the particular conditions.

According to the invention, an electrophotographic toner, an electrophotographic developer and a process for forming an image, in which the developing and transferring steps are stabilized with the lapse of time to obtain an image having high image quality that is particularly excellent in reproducibility and gradation property of neutral colors in a stable manner while the high transfer efficiency and the high image quality owing to the spherical toner parent particles are maintained, can be provided.

The entire disclosure of Japanese Patent Application No. 2001-008867 filed on Jan. 17, 2001 including specification, claims and abstract is incorporated herein by reference in its entirety.

What is claimed is:

1. An electrophotographic toner comprising toner parent particles having an average shape factor $ML^2/A$ in a range of about from 100 to 135 and a two or more kinds of inorganic particles having different average primary particle diameters, at least one kind of the inorganic particles being spherical particles having the average primary particle diameter in a range of about 80 to 300 nm, and the inorganic particles containing the spherical particles being attached to the toner parent particles to provide a structure satisfying the following conditions (1) and (2):

(1) the spherical particles have a coverage on a surface of the toner parent particles of about 20% or more; and (2) a proportion of the inorganic particles that are separated from the toner parent particles upon dispersing the toner in an aqueous solution is about 35% or less of a total addition amount of the inorganic particles.

2. The electrophotographic toner as claimed in claim 1, wherein the toner parent particles have an average shape factor $ML^2/A$ in a range of about from 100 to 130.

3. The electrophotographic toner as claimed in claim 1, wherein the spherical particles have an average primary particle diameter in a range of about from 100 to 200 nm.

4. The electrophotographic toner as claimed in claim 1, wherein the spherical particles are formed of silica.

5. The electrophotographic toner as claimed in claim 1, wherein the spherical particles have the Wardell's sphericity $\psi$ in a range of about from 0.8 to 1.0.

6. The electrophotographic toner as claimed in claim 1, wherein one kind of the inorganic particles has an average primary particle diameter in a range of about from 5 to 50 nm.

7. An electrophotographic developer comprising an electrophotographic toner and a carrier, the electrophotographic toner containing toner parent particles having an average shape factor $ML^2/A$ in a range of about from 100 to 135 and a two or more kinds of inorganic particles having different average primary particle diameters, at least one kind of the inorganic particles being spherical particles having the average primary particle diameter in a range of about 80 to 300 nm, and the inorganic particles containing the spherical particles being attached to the toner parent particles to provide a structure satisfying the following conditions (1) and (2):

(1) the spherical particles have a coverage on a surface of the toner parent particles of about 20% or more; and (2) a proportion of the inorganic particles that are separated from the toner parent particles upon dispersing the toner in an aqueous solution is about 35% or less of a total addition amount of the inorganic particles.

8. The electrophotographic developer as claimed in claim 7, wherein the spherical particles have an average primary particle diameter in a range of about from 100 to 200 nm.

9. The electrophotographic developer as claimed in claim 7, wherein the spherical particles are formed of silica.

10. The electrophotographic developer as claimed in claim 7, wherein the carrier comprises a ferrite core.

11. The electrophotographic developer as claimed in claim 7, wherein the carrier has an average particle diameter in a range of about from 30 to 80 $\mu$m.

12. The electrophotographic developer as claimed in claim 7, wherein one kind of the inorganic particles have an average primary particle diameter in a range of about from 5 to 50 nm.

13. A process for forming an image comprising the steps of:

forming an electrostatic latent image on a latent image holding member;

forming a developer layer containing an electrophotographic toner on a surface of a developer holding member arranged to face the latent image holding member, the electrophotographic toner comprising toner parent particles having an average shape factor $ML^2/A$ in a range of about from 100 to 135 and a two or more kinds of inorganic particles having different average primary particle diameters, at least one kind of the inorganic particles being spherical particles having the average primary particle diameter in a range of about 80 to 300 nm, and the inorganic particles containing the spherical particles being attached to the toner parent particles to provide a structure satisfying the following conditions (1) and (2):

(1) the spherical particles have a coverage on a surface of the toner parent particles of about 20% or more; and (2) a proportion of the inorganic particles that are separated from the toner parent particles upon dispersing the toner in an aqueous solution is about 35% or less of a total addition amount of the inorganic particles;

developing the electrostatic latent image on the latent image holding member with the developer layer to form a toner image; and transferring the toner image thus developed to a transfer material.

14. The process for forming an image as claimed in claim 13, wherein the spherical particles have an average primary particle diameter in a range of about from 100 to 200 nm.

15. The process for forming an image as claimed in claim 13, wherein the spherical particles are formed of silica.

16. The process for forming an image as claimed in claim 13, wherein the spherical particles have the Wardell's sphericity $\psi$ in a range of about from 0.8 to 1.0.

* * * * *